US011273660B2

(12) United States Patent
Westgate et al.

(10) Patent No.: US 11,273,660 B2
(45) Date of Patent: Mar. 15, 2022

(54) COVER SHEET, SECURITY DOCUMENT AND METHOD OF MANUFACTURING A SECURITY DOCUMENT

(71) Applicant: THALES DIS FRANCE SA, Meudon (FR)

(72) Inventors: David Westgate, Meudon (FR); Tommi Seppala, Meudon (FR)

(73) Assignee: THALES DIS FRANCE SA, Meudon (FR)

( * ) Notice: Subject to any disclaimer, the term of this patent is extended or adjusted under 35 U.S.C. 154(b) by 0 days.

(21) Appl. No.: 16/978,981

(22) PCT Filed: Feb. 22, 2019

(86) PCT No.: PCT/EP2019/054407
§ 371 (c)(1),
(2) Date: Sep. 8, 2020

(87) PCT Pub. No.: WO2019/170434
PCT Pub. Date: Sep. 12, 2019

(65) Prior Publication Data

US 2020/0406663 A1 Dec. 31, 2020

(30) Foreign Application Priority Data

Mar. 8, 2018 (EP) ..... 18305248

(51) Int. Cl.
*B42D 25/24* (2014.01)
*B42D 25/435* (2014.01)

(52) U.S. Cl.
CPC ..... *B42D 25/24* (2014.10); *B42D 25/435* (2014.10)

(58) Field of Classification Search
CPC ..... B42D 25/24; B42D 25/435
(Continued)

(56) References Cited

U.S. PATENT DOCUMENTS 5,380,695 A 1/1995 Chiang et al.
2006/0234014 A1 10/2006 Liu et al.
(Continued)

FOREIGN PATENT DOCUMENTS

EP 1538554 A2 6/2005
EP 2239149 A2 10/2010
(Continued)

OTHER PUBLICATIONS

PCT/EP2019/054407, International Search Report, dated Apr. 8, 2019, European Patent Office, P.B. 5818 Patentlaan 2, NL-2280 HV Rijswijk.

(Continued)

*Primary Examiner* — Justin V Lewis
(74) *Attorney, Agent, or Firm* — The Jansson Firm; Pehr B. Jansson

(57) ABSTRACT

Security document and method of manufacturing thereof. The security document having at least one bio data page and at least one paper data page stitched together, and at least one cover sheet placed outside the bio data page and the paper data pages, said cover sheet having at least one end paper sheet stitched with the stitched pages and one cover material sheet attached to the end paper sheet. The inside of the cover sheet is kiss cut in order to prevent any splitting of the cover sheet.

19 Claims, 3 Drawing Sheets

(58) Field of Classification Search
USPC ..... 281/2, 3.1, 5, 10, 15.1, 21.1, 27; 283/61, 283/62, 63.1, 64, 67, 70, 72, 74, 75, 77, 283/94, 98
See application file for complete search history.

(56) References Cited

U.S. PATENT DOCUMENTS

| | | | | |
|---|---|---|---|---|
| 2011/0019283 | A1 | 1/2011 | Steenblik et al. | |
| 2012/0018992 | A1* | 1/2012 | Nugent | B42D 25/00 281/27 |
| 2015/0227829 | A1* | 8/2015 | Finn | H01L 24/27 235/488 |

FOREIGN PATENT DOCUMENTS

| | | | |
|---|---|---|---|
| WO | WO9602048 | A1 | 1/1996 |
| WO | WO0054984 | A1 | 9/2000 |
| WO | WO2007034129 | A1 | 3/2007 |

OTHER PUBLICATIONS

PCT/EP2019/054407, Written Opinion of the International Searching Authority, dated Apr. 8, 2019, European Patent Office, D-80298 Munich.

* cited by examiner

COVER SHEET, SECURITY DOCUMENT AND METHOD OF MANUFACTURING A SECURITY DOCUMENT

FIELD OF THE INVENTION

The invention relates to a method for securing the cover sheet of a security document in order to prevent any splitting of the cover sheet. The invention relates also to a security document, such as a passport, obtained with this method.

The invention finds applications in the security field and, in particular, in the field of security documents having the form of booklets containing each one several pages, like passports.

BACKGROUND

Security documents such as passports are documents issued by a state to allow its citizens to travel abroad. These security documents, and passports in particular, are generally made up of various elements bound together as securely as possible in order to allow its holder to travel freely between states. They provide positive assurance that the identity is real and the person holding the document is correctly entitled to travel or enter a state. Lack of assurance based on poor quality of a document causes the traveller inconvenience as receiving states do not trust the document and conduct more checks or may impose visa regulations on the holder.

Passports include generally a lot of security elements—such as guilloches, holograms, personalized markings, RFID chip, etc.—that allow an authentication of the passport holder. All the security elements are distributed in one or several pages of the passport. However, passports are the subject of numerous forgeries and counterfeits, notably by manipulation of the data contained in the pages. Most of the access to the data page(s) have security surrounding them in order to prevent this happening, mainly associated with the hinge technology. Indeed, forgers often try to detach the data page(s) from the rest of the booklet in order to insert a counterfeit page, or to manipulate the data by overprinting or over lasering of the information.

To prevent these counterfeit and forgery activities, integrity in the booklet is a requirement by mostly states. Integrity preservation consists for example of preventing the access to the hinge, in particular to the stitching thread when the booklet is stitched. Indeed, as shown on FIG. 1, a passport 100 generally comprises a cover sheet 110 and pages 120 stitched together, the cover sheet being attached outside pages 120. The pages 120 comprise several paper data pages 121 and one bio data page 122 for example in the form of personalized data inserted in a polycarbonate (PC) data page. The cover sheet 110 comprises generally one or several end paper sheet(s) 112 and one cover material sheet 111 attached, for example glued, together in order to protect the stitching of the passport and hence the access to the bio data page.

However, this stitching protection is not sufficient for protecting the booklet integrity. Indeed, even if the stitching is protected, forgers may access to the stitching from the cover sheet, by splitting the cover sheet and hence obtaining access to said stitching.

SUMMARY OF THE INVENTION

In response to the above formulated problems of forgery and counterfeit risks from the cover sheet, the applicant is proposing a method for securing the cover sheet of passports or other security documents by kiss cutting the inside of said cover sheet.

According to a first aspect, the invention concerns a cover sheet for protecting pages of a security document, said cover sheet comprising a cover material sheet attached to an end paper sheet, wherein the cover sheet comprises at least one kiss cutting inside the cover sheet in order to prevent any splitting inside said cover sheet by delaminating the cover material sheet from the end paper sheet.

Such a cover sheet allows, among other advantages, to prevent any splitting of the cover sheet by any forger. Thus, a forger who wants to split the cover sheet will encounter the cuts so that the cover sheet will fragment and any reassembly attempt will be visible to the naked eye.

In the following description, the expressions "passport" or "security document" will designate in the same manner any document having the form of a booklet and containing security data specific to its holder.

Advantageously, the kiss cutting is extending with a variable depth inside said cover sheet.

According to some embodiments, the cover sheet comprises several kiss cuttings with various depth levels.

According to some embodiments, the cover sheet comprises several uneven kiss cuttings, each kiss cutting extending at different depth from surrounding kiss cuttings.

According to some embodiments, the depth of the kiss cutting has a bias profile.

According to some embodiments, the bias profile extends up to 85% deep of cover material thickness from an inside surface of the cover sheet.

According to some embodiments, the bias profile extends between 25% and 75% from an inside surface of the cover sheet.

According to some embodiments, the kiss cutting has a curve or a geometrical shape.

According to some embodiments, the kiss cutting has an alphanumerical characters shape.

According to some embodiments, the kiss cutting has a width defined according to the depth of said kiss cutting.

According to some embodiments, the kiss cuttings are made either in a reverse side of the end paper sheet or in the inside side of the cover material sheet.

According to some embodiments, the cover material sheet being made up of several material layers congregated with coating layers, each kiss cutting extends inside said material layers.

According to some embodiments, each kiss cutting is made by laser cut with a laser tool, by blade cut with a sharp tool, by embossing or printing with a tool having positive surface relief patterns or by mechanical milling with micro-tools.

According to second first aspect, the invention concerns a method for securing a security document cover sheet comprising:

- at least one bio data page and paper data pages stitched together, and
- at least one cover sheet placed outside the bio data page and the paper data pages, said cover sheet comprising at least one end paper sheet stitched with the other pages and one cover material sheet attached to the end paper sheet,
- the method being characterized in that it comprises, during security document manufacturing, a step of kiss cutting the inside of the cover sheet in order to prevent any splitting of the cover sheet.

Such a method allows, among other advantages, to prevent any splitting of the cover sheet by any forger. Thus, a forger who wants to split the cover sheet will encounter the cuts so that the cover sheet will fragment and any reassembly attempt will be visible to the naked eye.

Advantageously, the step of kiss cutting comprises several uneven cuts in the cover sheet. Such a configuration allows, in particular, to make it even more difficult to split the cover sheet.

According to some embodiments, the step of kiss cutting is made in a reverse side of the end paper sheet.

According to other embodiments, the step of kiss cutting is made in an inside side of the cover material sheet.

According to one or more embodiments, the cover sheet comprises several kiss cuttings with various depth levels.

According to one or more embodiments, each kiss cutting is made by laser cut with a laser tool or by blade cut with a sharp tool. According to other embodiments, each kiss cutting is made by embossing or printing with a tool having positive surface relief patterns or by mechanical milling with microtools.

According to a second aspect, the invention concerns a security document comprising at least:

one bio data page and paper data pages stitched together, and one cover sheet placed outside the bio data page and the paper data pages, said cover sheet comprising at least one end paper sheet stitched with the other pages and one cover material sheet attached to the end paper sheet, the security document being characterized in that it is obtained with the method defined above.

According to one or more embodiments, the cover sheet comprises at least one kiss cutting extending inside said cover sheet.

According to one or more embodiments, the cover sheet comprises at least one kiss cutting extending with a variable depth inside said cover sheet.

According to one or more embodiments, the cover sheet comprises several uneven kiss cuttings, each kiss cutting extending at different depth from surrounding kiss cuttings.

Such embodiments allow, in particular, to make even more difficult to split the cover sheet.

Advantageously, the depth of the kiss cutting has a bias profile. This bias profile may extend up to 85% from an inside surface of the cover sheet.

Advantageously, the kiss cutting has a curve or a geometrical shape or even an alphanumerical characters shape.

Advantageously, the kiss cutting has a width defined according to the depth of said kiss cutting.

According to one or more embodiments, the cover material sheet being made up of several material layers congregated with coating layers, each kiss cutting extends inside said material layers.

BRIEF DESCRIPTION OF THE DRAWINGS

A detailed description of some preferred embodiments is set forth herein below with reference to the following drawings, in which.

DETAILED DESCRIPTION

Figure 2:
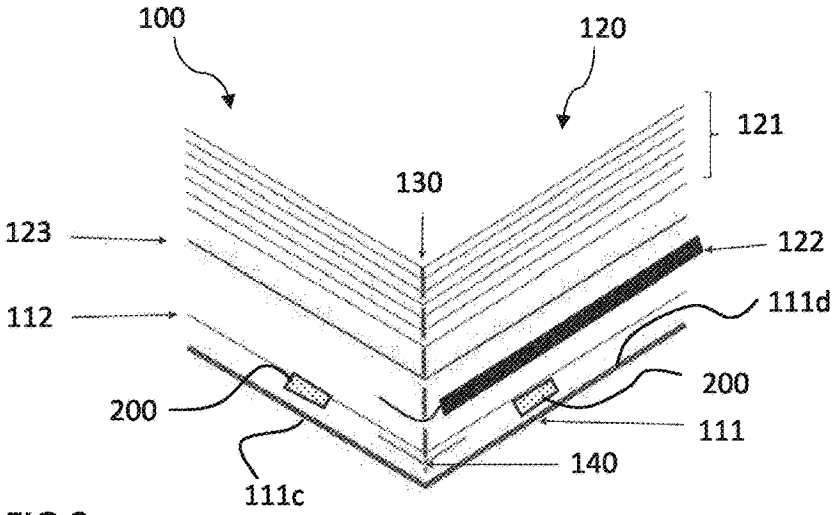
FIG. 2 is a cross-sectional view of a passport according to an embodiment of the invention wherein the passport comprises two bio data pages.

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example" means that a particular feature, structure, or characteristic described is included in at least one embodiment described herein and does not imply that the feature, structure, or characteristic is present in all embodiments described herein.

Figure 1:
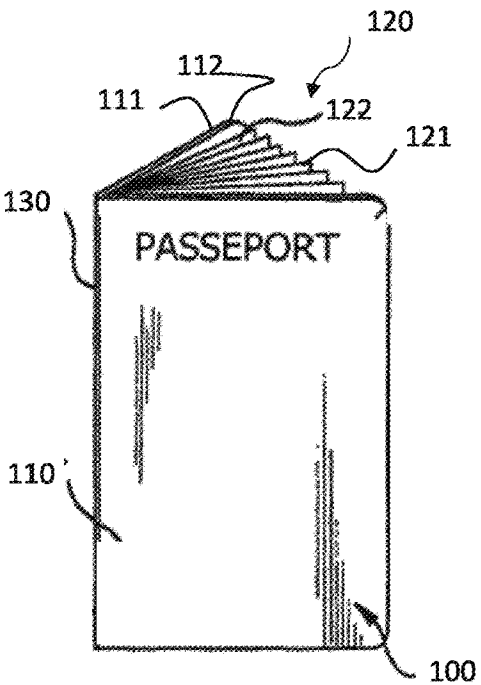
FIG. 1, already disclosed, is a general view of a passport according to the prior art.

The invention is proposing a method for preventing any splitting of the cover sheet of a passport. This method may be implemented in any passport of the type shown in FIG. 1, whatever its cover sheet. Indeed, the cover sheet 110 of the passport comprises generally at least one end paper sheet 112 attached, generally glued, to one cover material sheet 111. According to a variant, the cover material sheet comprises latex soaked papers. According to another variant, the cover material sheet comprises woven fabric. Whatever the variant, the cover sheet is fibrous and a cutting tool can slide inside the cover sheet and delaminate one layer.

The method according to the invention proposes to kiss cut inside the cover sheet in order to prevent any splitting inside said cover sheet. Kiss cutting is a die cutting process where foils or papers are cut through, but the laminated backing paper is not. In the invention, kiss cutting the cover sheet allows to make a cut in the depth of the cover sheet without cutting the surfaces (inside and outside surfaces) of said cover sheet. As described later, the kiss cuttings are made either in a reverse side of the end paper sheet 112 or in the inside side of the cover material sheet 111.

A cross-sectional view of an example of a passport 100 according to the invention is represented on FIG. 2. This view shows several sewn pages 120 and the cover sheet 110 protecting said pages. FIG. 2 shows also the sewing thread 130 joining pages and cover sheet together. According to the invention, the passport 100 comprises several pages 120. The pages 120 comprises several paper data pages 121, like visa pages, and one or more data page(s) incorporating personalized data relative to the holder and security elements such as OVI patch, hologram, ghost photo, guilloches, etc.

In the description herein after, a data page incorporating personalized data is named bio data page.

Figure 5:
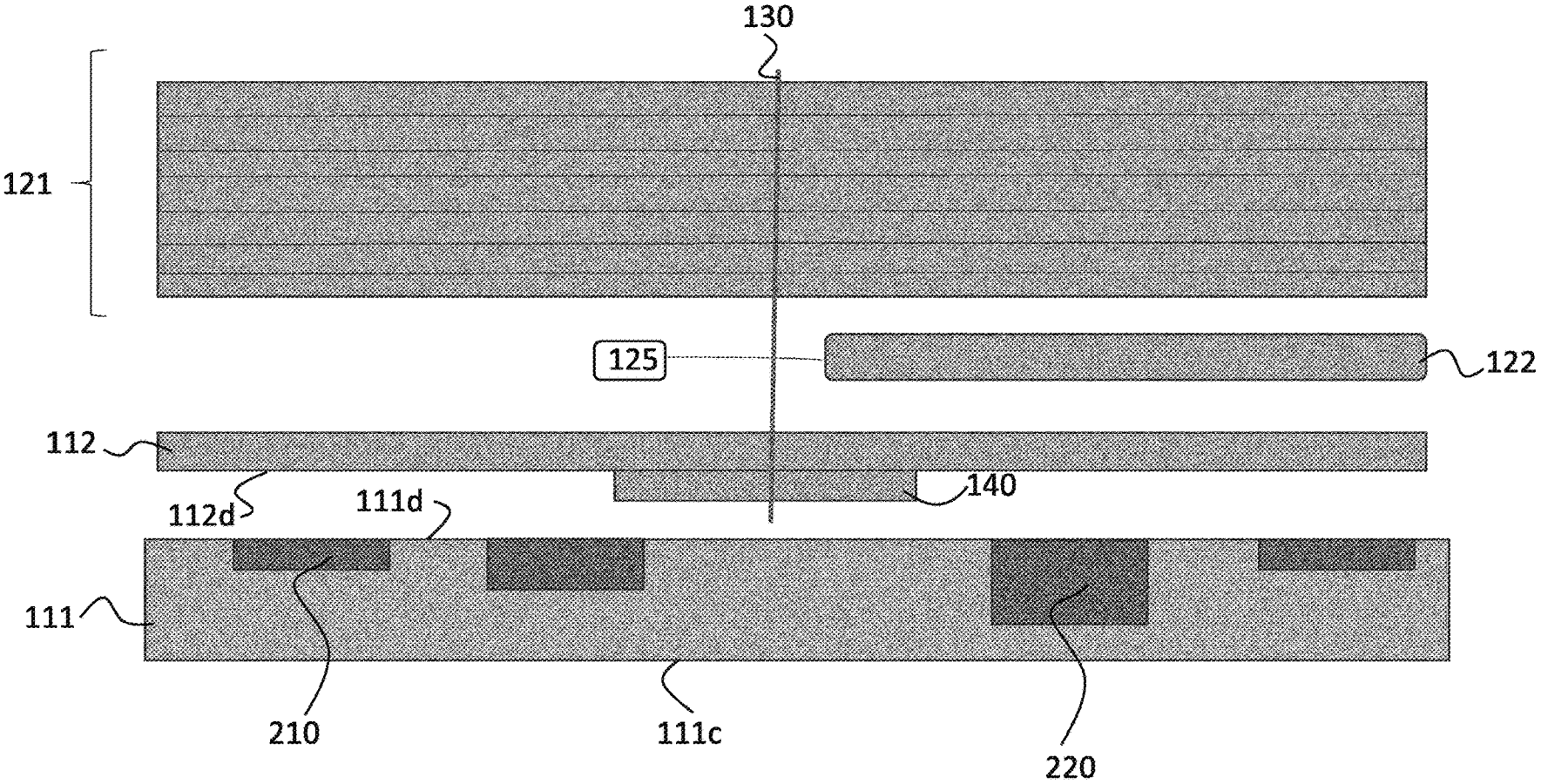
FIG. 5 is an example of a cross-sectional view of a passport according to an embodiment of the invention wherein the passport comprises one plastic bio data page.

In some embodiments, as this one represented on FIG. 5, the passport 100 comprises one bio data page 122 which is a plastic page sewn to the paper pages through a hinge 125. In some other embodiments, as this one represented on FIG. 6, the passport 100 comprises one bio data page 123 which is a paper page, for example the first visa page. In some other embodiments, as this one of FIG. 2, the pages 120 comprises two bio data pages 122, 123. In particular, in FIG. 2, the pages 120 comprises:

several paper data pages 121, like visa pages;

one first bio data page 122 in the form of a PC (polycarbonate) data page in which specific data relative to the holder and/or security elements are incorporated; and one second bio data page 123 in the form of a paper data page in which specific data relative to the holder and/or security elements—similar or different from these of bio data page 122—are incorporated.

Figure 6:
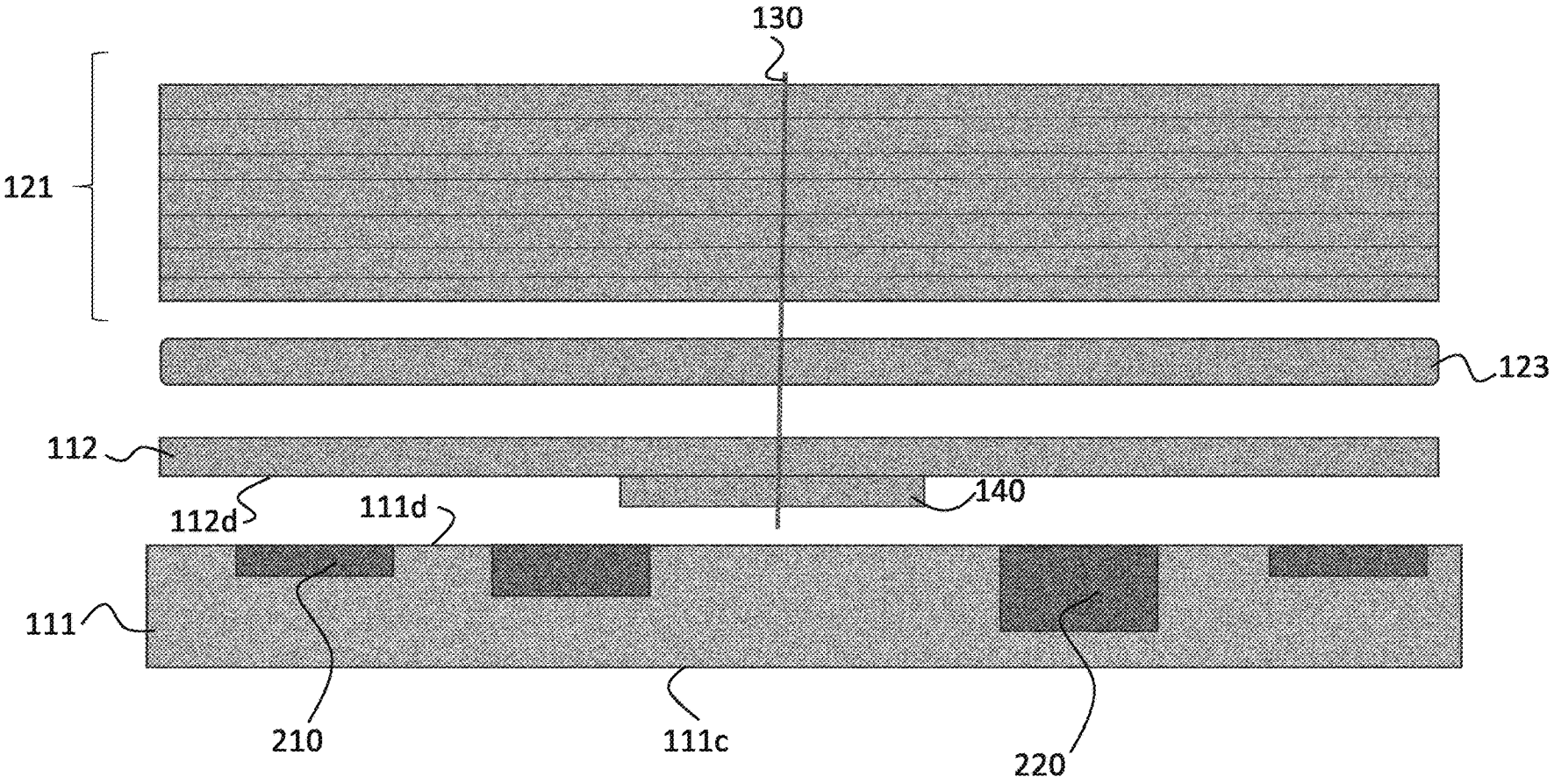
FIG. 6 is an example of a cross-sectional view of a passport according to an embodiment of the invention wherein the passport comprises one paper bio data page.

As shown in FIGS. 2, 5 and 6, the cover sheet 110 comprises the cover material sheet 111 and the end paper sheet 112. The spine tape 140 may be incorporated between the cover material sheet and the end paper sheet. The cover material sheet 111, and a fortiori, the cover sheet 110, is a fibrous material made up of many layers to give it rigidity, weight and to be able to hold the foil blocking.

On the examples of FIGS. 2, 5 and 6, two kiss cuttings 200 are also represented inside the cover sheet 110. Each kiss cutting is placed in the depth of the cover sheet in order to constitute a disruption in the splitting if a forger tries to split the cover sheet. Weakening locally the cover sheet by making cuts as deep as possible without causing any visible marks on the external surfaces of the cover sheet prevents any splitting by any forger. The forger who would try to split the cover sheet will encounter the cuts at some points and the cover would fragment and thwart the attack making it difficult to reassemble the document.

In the embodiment of FIG. 2, each kiss cutting 200 is made on the reverse side 112*d* of the end paper sheet 112, that is the side of the end paper sheet 112 facing the cover material sheet 111. In that case, the cover material sheet 111 glued to the end paper sheet 111 covers up the kiss cuttings 200 which are invisible for any user.

In the embodiments of FIGS. 5 and 6, each kiss cutting 200 is made in the inside side 111*d* of the cover material sheet 111, that is the side of the cover material sheet facing the end paper sheet 112. In that case, the end paper sheet 111 glued to the cover material sheet 111 covers up the kiss cuttings 200 which are invisible for any user.

Figure 3:
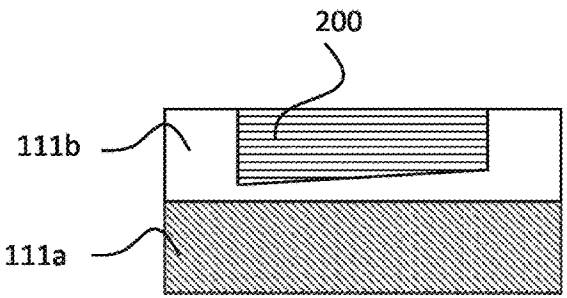
FIG. 3 is a schematic cross-sectional view of a kiss cutting inside a cover sheet according to the invention.

In preferred embodiments, the kiss cuttings 200 of the cover sheet are provided different from each other in the cover sheet depth, with different depth levels. In some embodiments, each kiss cutting may be placed at a depth level different from others, as shown on FIGS. 5 and 6. In other words, the kiss cuttings extend in the plane of the cover sheet, at depth levels different one from the others. Some kiss cuttings (e.g. these referenced 210) may extend at a depth near the reverse side of the end paper sheet 112 or the inside side of the cover material sheet 111, other kiss cuttings (e.g. these referenced 220) may extend deeper in the end paper sheet depth or the cover material sheet depth without ever reaching the recto side 112*d* of the end paper sheet or the outside side 111*c* of the cover material sheet. Each kiss cutting may extend at a depth level different from this of the surrounding kiss cuttings. Since a passport cover sheet has a thickness of up to 400 μm, the kiss cutting depth can be up to about 85% deep of the total cover material thickness in particular when the kiss cuttings are inside the cover material sheet. When the kiss cuttings are inside the end paper sheet, their depth can be up to 85% of the depth being dependent on the end paper sheet thickness In other embodiments, combinable with previous embodiments, the kiss cuttings extend with a variable depth level in the cover sheet. An example of a variable depth level kiss cutting is represented in FIG. 3. In this example, the kiss cutting 200 has a bias profile which extends from a depth near the inside side 111*d* of the cover material sheet 111 until a depth near the outside side 111*c*. In the example of FIG. 3, the cover material sheet 111 is made up of one or several material layers 111*b* (paper layers or woven fabric layers) congregated with coating layers 111*a*, the kiss cutting being provided in material layers.

In some embodiments, the method proposes to kiss cut between e.g. 25% to e.g. 75% of the inside of the cover sheet with a thin cut that start at one end at a low level and then move to the full depth. In other word, the kiss cutting may for example extend with a bias section starting at an about 25% depth from the inside surface and stopping at an about 75% depth from said inside surface.

According to the invention, the kiss cuttings may have a more or less thin width up to 200 μm, preferably below 100 μm. A thin width below 100 μm is sufficient for interrupting splitting inside the cover sheet. However, the cut width may be larger: it may be for example defined according to the depth of the kiss cutting. Alternatively, the cut profile may have variable width, e.g. a V-shape which is more wide on the surface of the cover material sheet and narrow at the bottom of the cut.

Figure 4:
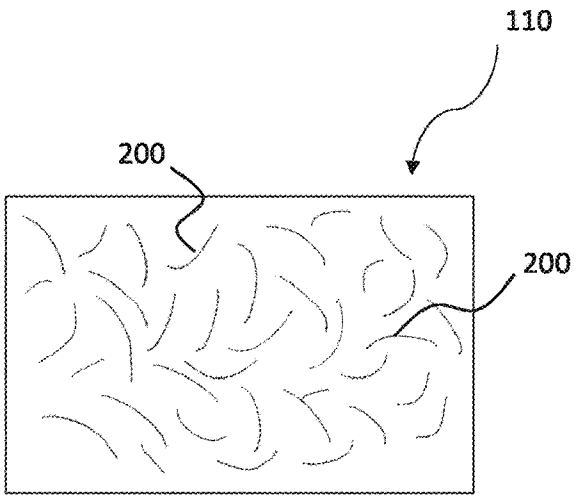
FIG. 4 is an example of a top view of kiss cuttings inside a cover sheet according to the invention.

According to the invention, the kiss cuttings may be straight lines, geometrical shapes with angles inside, curved shapes or any other shapes such as, for example, alphanumerical characters shapes. In the example of FIG. 4, the represented kiss cuttings 200 are curved cuts with various curves and lengths and which are unevenly spread inside the cover sheet.

According to some embodiments, the kiss cuttings can be made with various technologies, such as with a sharp tool cutting not fully through the cover sheet but in depth between the inside surface and the outside surface of the cover sheet 110. Some printing technologies could also be used to push the kiss cuttings inside the cover sheet 110 with a printing plate having positive surface relief embossing. Further, some embossing process could be used with a tool having positive surface relief patterns.

Other embodiments like laser cutting with a laser tool or embossing with hot embossed plate or mechanical milling with microtools could also be used for kiss cutting.

While only some selected embodiments have been chosen to illustrate the present invention, it will be apparent to the skilled person from this disclosure that various changes and modifications can be made herein without departing from the scope of the invention as defined in the appended claims. The structures and functions of one embodiment can be adopted in another embodiment. Further, it is not necessary for all advantages to be present in particular embodiments at the same time.

The invention claimed is:

1. A cover sheet for protecting pages of a security document, said cover sheet comprising a cover material sheet attached to an end paper sheet, wherein the cover material sheet has an external surface and an inside surface, the end paper sheet has an external surface and an inside surface, the cover material sheet being laminated to the end paper sheet by the inside surface of the cover material sheet being attached to the inside surface of the end paper sheet, and the cover sheet comprises at least one kiss cutting internally to the cover sheet and wherein the at least one kiss cutting is extended in a plane of the cover sheet without causing any visible marks on the external surfaces of the cover material sheet and the end paper sheet thereby preventing splitting said cover sheet by delaminating the cover material sheet from the end paper sheet.

2. The cover sheet according to claim 1, wherein the at least one kiss cutting extends inside said cover sheet from a first depth to a second depth wherein the first depth is closer than the second depth to the inside surface of said end paper sheet.

3. The cover sheet according to claim 1, wherein the cover sheet comprises several kiss cuttings having different depth levels.

4. The cover sheet according to claim 1, wherein the cover sheet comprises several uneven kiss cuttings, each kiss cutting extending to a depth that is different from the depth to which surrounding kiss cuttings extend.

5. The cover sheet according to claim 1, wherein the at least one kiss cutting has a depth profile extending from a first depth to a second depth wherein the first depth is closer than the second depth to the inside surface of said end paper sheet.

6. The cover sheet according to claim 5, wherein the first depth extends up to a depth equal to 85% of cover material thickness measured from the inside surface of the cover material sheet, wherein a depth of 0% corresponds to a depth located at the inside surface of the cover material sheet, and a depth of 100% corresponds to a depth located at the external surface of the cover material sheet.

7. The cover sheet according to the claim 5, wherein the the first and second depths extend to depths between 25% and 75% of the cover material thickness measured from the inside surface of the cover sheet material or end paper sheet to the external surface of the cover sheet material or end paper sheet material, respectively, wherein a depth of 0% corresponds to a depth located at the inside surface of the cover material sheet, and a depth of 100% corresponds a depth located at the external surface of the cover material sheet.

8. The cover sheet according to claim 1, wherein the kiss cutting has a curve or a geometrical shape.

9. The cover sheet according to claim 1, wherein the kiss cutting has an alphanumerical-character shape.

10. The cover sheet according to claim 1, wherein the kiss cutting has a variable width profile.

11. The cover sheet according to claim 10, wherein the kiss cutting has a V-shaped profile.

12. The cover sheet according to claim 1, wherein the kiss cuttings are made either in the inside surface of the end paper sheet or in the inside surface of the cover material sheet.

13. The cover sheet according to claim 1, wherein the cover material sheet comprises at least one material layer congregated with at least one coating layer, and wherein each kiss cutting extends inside of said at least one material layers.

14. The cover sheet according to claim 1 wherein the kiss cutting is of a width up to 200 μm.

15. The cover sheet according to claim 1 wherein the kiss cutting is of a width less than 100 μm.

16. A security document comprising at least:

one bio data page and one paper data page stitched together, and one cover sheet placed outside the bio data page and the at least one paper data page, said cover sheet comprising at least one end paper sheet stitched with the stitched pages and one cover material sheet having an external surface and an inside surface attached to the end paper sheet which has an external surface and an inside surface, the cover material sheet being laminated to the end paper sheet by the inside surface of the cover material sheet being attached to the inside surface of the end paper sheet, wherein the cover sheet comprises at least one kiss cutting extended in a plane of the cover sheet without any visible marks on the external surfaces of the cover sheet material and the end paper sheet thereby preventing splitting said cover sheet by delaminating the cover material sheet from the end paper sheet.

17. The security document according to claim 16, wherein the security document is a passport.

18. A method for manufacturing a security document having at least one bio data page and at least one data page stitched together, and at least one cover sheet placed outside the bio data page and at least one data page, said cover sheet comprising at least one end paper sheet, having an external surface and an inside surface, and stitched with the stitched pages and one cover material sheet, having an external surface and an inside surface, and laminated to the at least one end paper sheet by the inside surface of the cover material sheet being attached to the inside surface of the end paper sheet, the method comprising: during security document manufacturing, kiss cutting the cover material sheet or the end paper sheet, the kiss cutting extended in a plane of the cover sheet without causing any visible marks on the external surfaces of the cover material sheet or on the end paper sheet thereby preventing splitting said cover sheet by delaminating the cover material sheet from the end paper sheet.

19. The method according to claim 18, wherein each kiss cutting is made by laser cut with a laser tool, by blade cut with a sharp tool, by embossing or printing with a tool having positive surface relief patterns or by mechanical milling with microtools.

* * * * *